US008026465B1

(12) United States Patent
Fraysse, Jr.

(10) Patent No.: US 8,026,465 B1
(45) Date of Patent: Sep. 27, 2011

(54) GUIDED FUSE WITH VARIABLE INCIDENCE PANELS

(75) Inventor: John W. Fraysse, Jr., Mechanicsville, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 328 days.

(21) Appl. No.: 12/456,272

(22) Filed: May 20, 2009

(51) Int. Cl.
*F42B 15/01* (2006.01)

(52) U.S. Cl. ..... 244/3.22; 244/3.24

(58) Field of Classification Search ..... 244/3.21, 244/3.22, 3.24, 3.2, 3.26, 3.27, 3.29, 49
See application file for complete search history.

(56) References Cited

U.S. PATENT DOCUMENTS

| | | | | |
|---|---|---|---|---|
| 3,276,376 | A * | 10/1966 | Cubbison et al. | 244/3.22 |
| 4,664,339 | A * | 5/1987 | Crossfield | 244/3.28 |
| 4,667,899 | A * | 5/1987 | Wedertz | 244/49 |
| 4,869,442 | A * | 9/1989 | Miller | 244/3.28 |
| 5,393,011 | A * | 2/1995 | Dunn et al. | 244/3.21 |
| 5,393,012 | A * | 2/1995 | Dunn | 244/3.23 |
| 5,507,452 | A | 4/1996 | Mayersak | 244/3.15 |
| 5,866,838 | A | 2/1999 | Mayersak | 89/1.56 |
| 6,276,277 | B1 | 8/2001 | Schmacker | 102/384 |
| 6,502,785 | B1 * | 1/2003 | Teter et al. | 244/3.22 |
| 6,502,786 | B2 | 1/2003 | Rupert et al. | 244/3.27 |
| 6,748,871 | B2 * | 6/2004 | Hellman | 102/490 |
| 6,761,331 | B2 * | 7/2004 | Eisentraut et al. | 244/3.28 |
| 6,905,093 | B2 * | 6/2005 | Dryer et al. | 244/3.28 |
| 6,981,672 | B2 | 1/2006 | Clancy et al. | 244/3.21 |
| 7,163,176 | B1 | 1/2007 | Geswender et al. | 244/3.27 |
| 7,226,015 | B1 * | 6/2007 | Prince et al. | 244/3.21 |
| 7,267,298 | B2 * | 9/2007 | Leininger | 244/3.24 |
| 7,354,017 | B2 * | 4/2008 | Morris et al. | 244/3.23 |
| 7,732,741 | B1 * | 6/2010 | Whitham | 244/3.27 |
| 2004/0011920 | A1 * | 1/2004 | Johnsson et al. | 244/3.29 |
| 2004/0041059 | A1 * | 3/2004 | Kennedy et al. | 244/3.29 |
| 2004/0055501 | A1 * | 3/2004 | Hunn et al. | 102/501 |
| 2004/0094661 | A1 * | 5/2004 | Johnsson et al. | 244/3.27 |
| 2004/0144888 | A1 * | 7/2004 | Dryer et al. | 244/3.27 |
| 2005/0236514 | A1 * | 10/2005 | Lawless | 244/3.27 |
| 2008/0001023 | A1 * | 1/2008 | Schroeder | 244/3.24 |
| 2008/0029641 | A1 * | 2/2008 | Carlson et al. | 244/3.24 |
| 2011/0073705 | A1 * | 3/2011 | Huguenin et al. | 244/3.24 |

FOREIGN PATENT DOCUMENTS

WO WO 2008143707 A2 * 11/2008

* cited by examiner

*Primary Examiner* — Benjamin P Lee
(74) *Attorney, Agent, or Firm* — Gerhard W. Thielman, Esq.

(57) ABSTRACT

A guided fuse is provided for installation on a projectile at its nose. The fuse includes a conical frustrum housing, a pair of control panels rotatably connected to pivotable knuckles, and a pair of drag panels disposed on hinges. Each of the control panels releases on command from stowage to deployment. Stowage configuration disposes each control and drag panel to conform against the housing, whereas deployment configuration separately splays the control and drag panels radially outward from the housing. In response to maneuver commands, each control panel turns on one of the knuckles along a radial control axis substantially perpendicular to the longitudinal axis. The control panels turn together either the same angular direction or the opposite angular direction. The control and drag panels form a cruciform pattern along the exterior. The fuse delivers torque from an actuator activated by the controller to the knuckles in response release and/or maneuver commands, and to the hinges in response to release command.

10 Claims, 6 Drawing Sheets

GUIDED FUSE WITH VARIABLE INCIDENCE PANELS

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a guided fuse. In particular, this invention relates to a warhead fuse having control surfaces to controllably adjust the weapon's trajectory toward an intended target.

The Army and Navy possess large stockpiles of conventional munitions. The Navy has approximately two-hundred-thousand 5-inch conventional rounds, whereas the Army and Marines together have nearly 10 million, 155 mm and 105 mm projectiles. The latter services are generally satisfied with the range and lethality of these munitions against a wide variety of target types given accurate delivery and proper fusing.

However, the accuracy, as measured by the circular error of probability (CEP) for Army and Navy projectiles is several hundred meters. Due to this inaccuracy, hundreds of rounds and tens of minutes may be necessary to neutralize even a single threat. This expenditure consumes lethal-force resources and prolongs exposure of launch platforms to hostile action, as well as tax resupply networks with burdensome logistic demands.

SUMMARY

Conventional fuses yield disadvantages addressed by various exemplary embodiments of the present invention. In particular, some munitions are constrained by design to trajectories that limit aerodynamic maneuverability. Additionally, spin stabilization or lack thereof can impose constraints on flight stability. Moreover, solutions to these conditions cannot be conventionally achieved by a ubiquitous fuse design. Thus, various exemplary embodiments rectify these deficiencies by providing a nose-mounted guided fuse within a standard geometric envelope that can maneuver a projectile on which it mounts for more accurate guidance to a target.

Various exemplary embodiments provide a guided fuse for installation on a projectile at its nose. The fuse includes a housing, a pair of control panels rotatably connected to pivotable knuckles, and a pair of drag panels disposed on hinges. The housing has a substantially conical frustum geometry with a radially expanding exterior disposed between a fore tip and an aft base along a longitudinal axis. Each of the control and drag panels releases on command from stowage to deployment. The pivotable knuckles insert into the housing.

Stowage configuration disposes each control and drag panel to conform against the exterior. Deployment configuration separately splays each control and drag panel radially outward from the exterior. In response to maneuver commands, each control panel turns on the knuckles along a control axis substantially perpendicular to the longitudinal axis. In various exemplary embodiments, the control panels turn together either the same angular direction or the opposite angular direction. The fuse delivers torque from an actuator activated by the controller to the knuckles in response release and/or maneuver commands, and to the hinges in response to release command.

In various exemplary embodiments, the guided fuse can further include plurality of antenna patches disposed to conform against the exterior and distributed between the pair of control panels and the pair of drag panels. The control and drag panels form a first cruciform pattern along the exterior, and the antenna patches form a second cruciform pattern angularly offset from the first.

In various exemplary embodiments, the base can include screw threads for installing in the nose of the projectile. An initiator at the base can initiate the projectile's payload, such as to detonate a warhead or deploy submunitions. The tip can include an altimeter to communicate with the initiator, or alternatively a terminal seeker for hit-to-kill initiation.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide a low-cost, yet robust and generally applicable form of guidance, navigation and control that fits within the confines of the North Atlantic Treaty Organization (NATO) Standard Fuse Envelope (MIL-STD-333B). Specifically, the exemplary Variable-Incidence-Panel with Error Reduction (VIPER) guided fuse concept employs control panels having variable-incidence in flight to adjust the aerodynamic drag, body spin rates and/or lift characteristics of a projectile. In particular, the nose-mounted VIPER fits all existing "NATO Standard" ammunition (ammo) types, such that the terminal accuracy of these munitions can be improved by an order of magnitude. This accuracy translates into reduction in circular error of probability (CEP). For munitions equipped with a low-cost semi-active laser seeker, the CEP can be reduced to less than one meter.

Figure 1A:
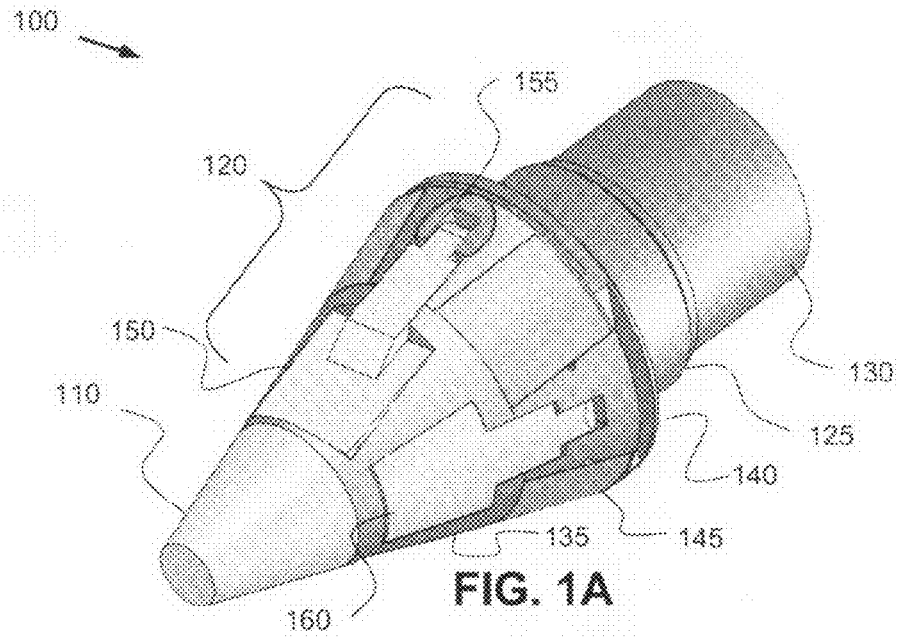
FIGS. 1A and 1B are isometric assembly views of a guided fuse.

FIG. 1A shows a first isometric assembly view 100 of a VIPER guided fuse. The assembly includes an altimeter or seeker nose-cone 110 and a control package 120 with an adaptor ring 125 connecting to a munitions-mount 130. The nose-cone 110 houses a multiple-option fuse/artillery (MOFA) height-of-burst (HOB) altimeter, which includes inductive coils that receive electromagnetic signals sent from the Army's EPIAFS system. Alternatively, the nose-cone 110 can be equipped with a terminal seeker that indicates physical contact with the target for hit-to-kill initiation of the warhead. The control package 120 includes a fore cover 135 and an aft assembly housing 140 onto which are disposed along the exterior four antennae 145, two control panels 150 mounted to corresponding pivotable joints 155, and two drag panels 160. The control package 120 forms a substantially conical frustum geometry with a radially expanding exterior disposed between a fore tip and an aft base along a longitudinal axis.

The antennae 145 are arranged in a cruciform pattern, 90° apart from each other around the control package 120 along its exterior. The control and drag panels 150, 160 are disposed as stowed, being the minimal drag configuration for the VIPER (at zero incidence). The control panels 150 with rotatable knuckle-hinges 155 are arranged opposite each other, 180° apart. The drag panels 160 are separately arranged opposite each other. Together, the panels 150, 160 form a cruciform pattern (90° apart from each other) around the control package 120 and adjacent to the antennae 145. The cruciform pattern of the control and drag panels 150, 160 are angularly offset from the cruciform pattern of the antennae 145 by 45°.

Figure 1B:
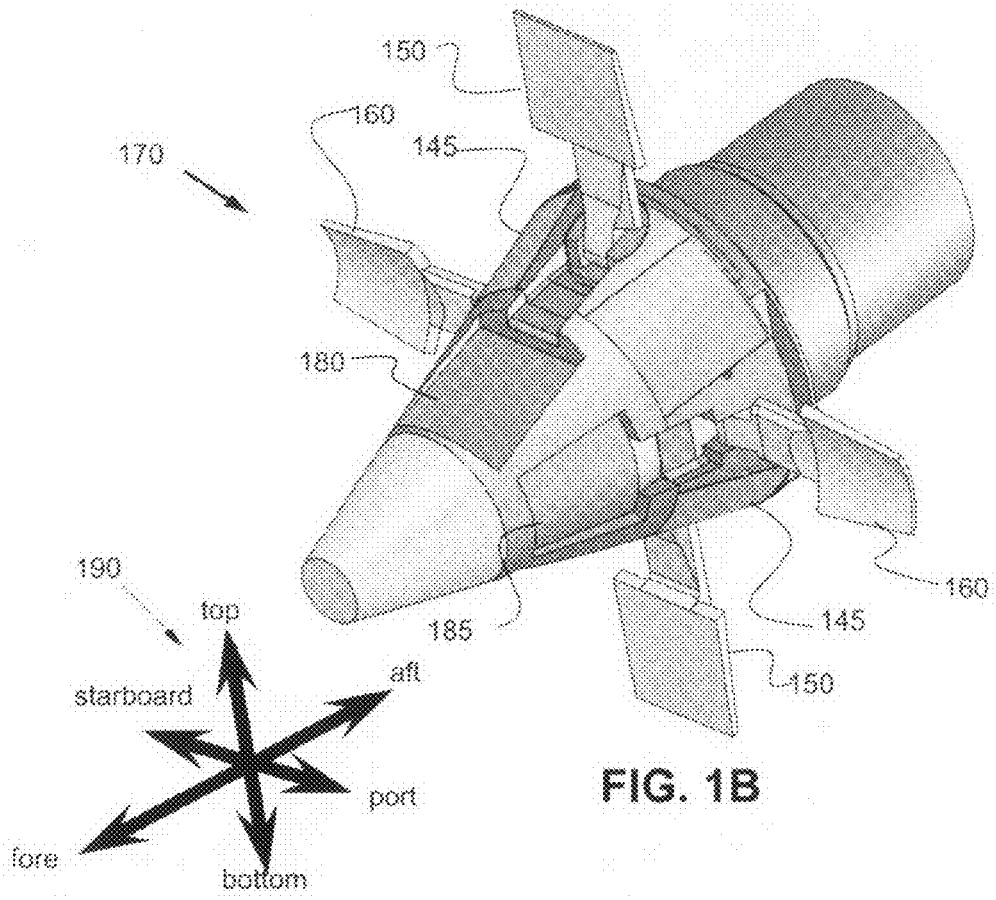

FIG. 1B shows a second isometric assembly view 170 of the VIPER guided fuse. The control and drag panels 150, 160 extend radially as rotatably deployed, being the maximum drag configuration for the VIPER (at zero incidence). The control package 120 reveals recesses 180 and 185. Each control recess 180 provides space into which a control panel 150 inserts for stowage. Each drag recess 185 provides space into which a drag panel 160 inserts for stowage.

A compass rose 190 orients the directional axes of the VIPER fuse. The longitudinal roll axis extends between fore and aft ends; the vertical yaw axis extends between up and down ends; and the lateral pitch axis extends between port and starboard ends. The control panels 150 deploy radially outward by pivoting along the lateral pitch axis towards up and down, and can turn on their knuckles 155 along the vertical yaw axis. The drag panels 160 deploy radially outward by pivoting on the vertical yaw axis towards starboard and port.

Figures 2A, 2B:
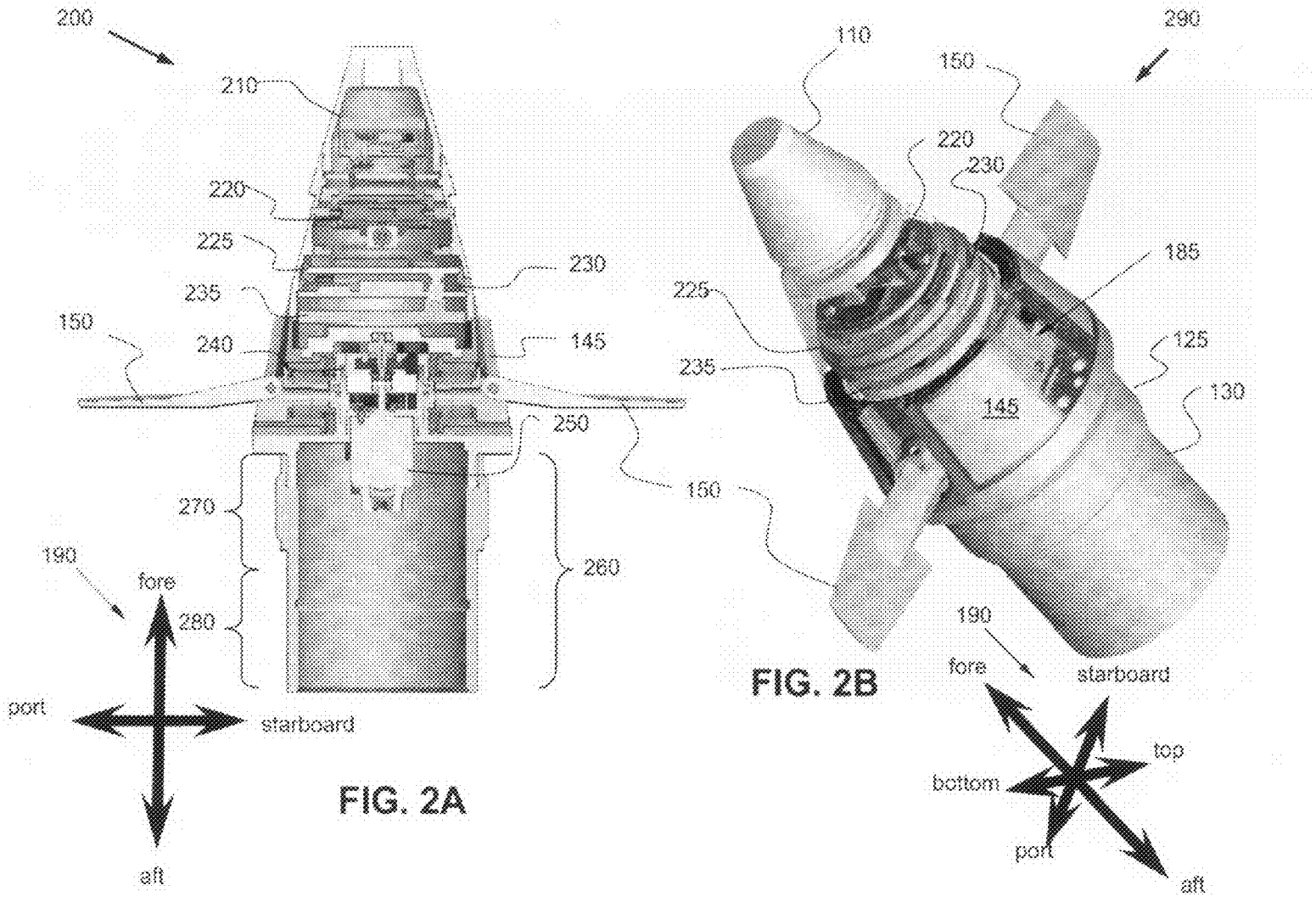
FIGS. 2A and 2B are elevation and isometric cross-sectional views of the guided fuse.

FIG. 2A shows an elevation cross-sectional view 200 of the VIPER guided fuse. The nose 110 houses the MOFA HOB sensor 210. An electromechanical package within the assembly housing 140 includes a panel release mechanism 220 (to unfurl the control panel 150), a flight computer 225, a Selective Availability Anti-Spoofing Module (SAASM) receiver 230 and an anti-jam module 235. Also within the assembly housing 140 and extending into the adaptor ring 125 are a reduction gear-box 240 and an actuator 250 to pivot the knuckle 155.

The adaptor ring 125 and munitions-mount 130 possess an exterior 260 that conforms to NATO standard thread and NATO standard intrusion geometry requirements. That exterior 260 includes an upstream battery compartment 270 and a downstream compartment 280. The upstream compartment 270 contains electrical storage batteries. A quad-set of Tadiran 1530MF cell-batteries 245 provide an exemplary source, capable of withstanding 30 kGs of acceleration and a 20-year shelf-life, representing commercial off-the-shelf (COTS) hardware available from Tadiran Batteries Ltd., 34 Rabin Blvd, 76950 Kiryat Ekron, Israel. The downstream compartment 280 contains the MOFA S&A device with primer. FIG. 2B shows, an isometric cross-sectional view 290 of the VIPER guided fuse, including the antennas 145 and the drag recess 185.

Each control panel 150 stows conformally around the control package 120. The control panels 150 deploy on demand to provide variable-incidence deflections. These two panels 150 can operate differently according to the control method that the fuse uses. When executing the lift method (LM), the control panels 150 move collectively such as by attachment to a common drive shaft, thereby producing lift from the host airframe as the projectile airframe rolls slowly (10 Hz to 20 Hz). Under the momentum method (MM), the control panels 150 move differentially with respect to one another to produce bi-directional roll accelerations and changes in the total drag of the spin-stabilized host projectile.

Each drag panel 160 also stows conformally around the control package 120. The drag panels 160 deploy on demand and provide a step increase in the total drag of the host projectile. These two panels 160 are used to correct large range errors early in the trajectory, or as a final (vernier) adjustment at the end of flight to minimize the final range-wise miss distance. Once deployed, these panels do not deflect in preferred embodiments, although they can be designed to have a variable extension angle. This added complication (and cost) has been investigated but does not appear to be necessary for typical operations.

The antennae 145 provide the GPS receiver system that includes four small patch antennae, inter-digized between the control and drag panels 150, 160. This antenna configuration supports future upgrades to the GPS system and future improvements in anti-jam technologies.

The adaptor ring 125 includes the S&A threaded interface 260 of the assembly 120, being compatible with the NATO standard thread, as well as the "short intrusion" dimensions contained in STANAG-333b. The adaptor ring 125 enables different S&A and primer configurations to be attached as an intrusion interface of the projectile body. The munitions-mount 130 of the assembly 120 houses the power system, as well as the primer to detonate the warhead or else initiate submunition-payloads.

The control panels 150 deploy and maneuver in response to commands to the actuator 250 from controller circuitry in the flight computer 225 based on inputs from the SAASM receiver 230. The drag panels 160 are similarly deployed. The munitions-mount 130 thus includes a transmission system including the gear-box 240 to enable the control panels 150 to rotate together in the same direction or together in opposite directions, depending on whether the Lift or Momentum methods are used. The actuator 250 delivers torque through the gear-box 240 to the knuckle 155 for the control panel 150 and hinge for the drag panel 160, and in turn is powered by the batteries contained in the upper compartment 270. The actuator 250 may incorporate a motor to provide mechanical torque.

Using a nose-mounted fuse to steer a spin-stabilized projectile was initially investigated in the early 1970's. However, these concepts were comparatively large externally, rendering them incompatible with existing autoloaders. Additionally, the guidance mechanisms and controllers protruded deep into the body of their host projectiles, rendering such designs incompatible with actual tactical rounds. Conventionally, the only guided fuse concept compliant with MIL-STD-333B that has successfully demonstrated closed-loop, two-dimensional homing (down-range and cross-range error reduction) has been the Navy's Guidance Integrated Fuse (GIF) program in May of 2008.

However, none of the existing guided fuse designs (including GIF) satisfy both the (MIL-STD-333B) envelope and general applicability to a wide range of ammo types, sizes and flight conditions. Conventional fuse designs attempt to produce lift and subsequently control the direction of trajectory to affect target homing. However, the production of lift is not generally viable for some conditions. For example, dynamic pressure differential for lift generation cannot be adequately achieved at subsonic speeds. This may include a projectile with a low-drag profile, such as by a slender ogive geometry or from a boat-tail. Moreover, spin-stabilized low-drag rounds render sufficient lift for achieving such control to be unavailable as a consequence of the continuous roll.

By contrast, the VIPER guided fuse can maneuver without generating lift (or at an angle-of-attack) by managing the momentum of the projectile, specifically, the linear (down-range) and spin momentums. This approach, called Momentum Method, avoids the problems associated with generating lift, called Lift Method. Because the control panels are continuously variable, a very wide variety of ammo types and flight conditions can be accommodated.

Conventional discrete or "one-shot" methods of momentum control, which deploy drag and roll brakes, have been unsuccessful because they can not be timed accurately under conditions that require large corrections. Also, such conventional methods cannot provide adequate roll rate control without inducing dynamic instabilities in typical flight conditions. The variable-incidence feature of the VIPER control panels enables the flight management system to implement control within the bounds of gyroscopic and dynamic stability.

The aerodynamic characteristics of ten's of different projectile types can be easily stored in the memory of each VIPER fuse. Immediately prior to launch, the ammo type can be identified to the VIPER fuse by an appropriate setting device, such as the Army's (Universal) Enhanced Projectile Inductive Artillery Fuse Setter (EPIAFS), which also transmits target coordinates, fuse modes and other required GPS data. EPIAFS represents a commercial-off-the-shelf (COTS) fuse module developed by the Army's Multi-Option Fuse Artillery program.

The external dimensions and mass properties of the VIPER fuse comply with the STANAG-333b requirements under MIL-STD-333B (i.e., the NATO envelope). However, the fuse intrusion into the projectile body also has a threaded interface that accepts a wide range of safe-and-arm (S&A) and primer configurations. This feature allows the VIPER fuse to safely initiate a wide range of different warhead payloads such as high-explosive, submunition, white phosphorus and illumination packages. The VIPER fuse can be inductively set by the Army's EPIAFS. This setting process transmits data which include ammo type, fuse modes, GPS parameters and target coordinates. Control surfaces used to maneuver the host projectile are conformally stowed around the fuse body and are packaged entirely within the STANAG-333b outer body line requirements.

There are two basic ways to steer or control ballistic launched (nominally unguided) munitions. The Lift Method serves as the first, and conventional, approach by generating aerodynamic lift and then controlling direction. The Momentum Method provides the second way to manage or control the linear and angular momentum of the projectile. Generally, the Momentum Method provides less accuracy than the Lift Method and thus is more applicable to spin stabilized (aerodynamically unstable) munitions. The Lift Method is capable of high precision and is usually better suited to fin stabilized (aerodynamically stable) weapons. The VIPER fuse is capable of implementing both the Lift and Momentum control methods.

Lift Methods create lift, e.g., by spin at positive angle-of-attack, and subsequently attempt to control the lift's magnitude and direction. This also implies that the orientation of the projectile is approximately known, such as least the local "vertical" vector. Lift Methods tend to be precise, can be used to extend range and are best suited for aerodynamically stable (usually fin-stabilized) munitions. VIPER uses a Lift Method when applied to existing fin-stabilize munitions or rounds currently under development.

By contrast, Momentum Methods do not generate or control lift at all. Instead they attempt to manage the inherent linear and angular momentums that naturally occur as a result of launch, e.g., down-range linear momentum and spin momentum. In general, Momentum Methods are optimally suited for spin-stabilized munitions (conventional projectiles), cannot be used to extend range, and are typically less precise than Lift Methods. To affect an increase or decrease in down-range, a Momentum Method adds thrust or drag, respectively.

However, because a controllable thrust with enough control authority cannot be accomplished in such a small volume as the NATO envelope, another acceptable procedure involves deliberately firing the round long of (i.e., beyond) the target and then modulate the drag on the projectile (to controllably shorten the range). To induce lateral deflection, the Momentum method increases or decreases the nominal spin rate of the projectile. VIPER uses drag and spin rate modulation to affect trajectory control via the Momentum Method on existing spin-stabilized munitions.

The guidance algorithm used by VIPER is referred to as "Forward Integrated Terminal States" (FITS), introduced in 1998 at Naval Surface Warfare Center at Dahlgren, Va. FITS provides an optimal guidance law for ballistic munitions that uses the outputs from the GPS receiver to initialize a three-degrees-of-freedom trajectory model or "predictor" of the host projectile. The predictor then estimates where and when the warhead would impact the ground.

For the Lift Method, commanded maneuvers are generated by differencing the predicted impact coordinates $P_i$ with the pre-programmed target position $P_t$, multiplying the result $(P_i-P_t)$ by a navigation gain K and then dividing the product by the square of the estimated time-to-go $t_{go}$ until impact, as expressed by $M_c=K(P_i-P_t)\div t_{go}^2$, where $M_c$ represents the commanded maneuver at each GPS update. This "predictive" guidance law concept maneuvers the projectile until the estimate indicates no further correction being warranted—in effect "zero effort" (or ballistic) trajectory to the target.

In response to the navigation gain K being set sufficiently high, e.g., $2<K<3$, the FITS algorithm can usually achieve a ballistic solution several seconds prior to impact. That is, the FITS algorithm produces a trajectory that hits the target without any guidance during the last several seconds of flight. This, in turn, reduces dependence of the projectile's final accuracy GPS during the terminal phases of flight, and also minimizes or eliminates the need for an inertial maneuvering unit (IMU) to execute inertial guidance during the terminal phase in the event of GPS signal loss. Electromagnetic signal jamming by the intended target can deprive the projectile receipt of the GPS signal for course correction, thereby showcasing an advantage of the FITS algorithm.

For the Momentum Method on existing spin-stabilized projectiles, miss distances from the FITS Predictor can be calculated at every GPS update for each of the four (4) VIPER control modes: spin, de-spin, pitch-up and pitch-down. The flight management system then selects the mode that produces the minimum final miss distance.

Figures 3A, 3B, 3C, 3D, 3E, 3F:
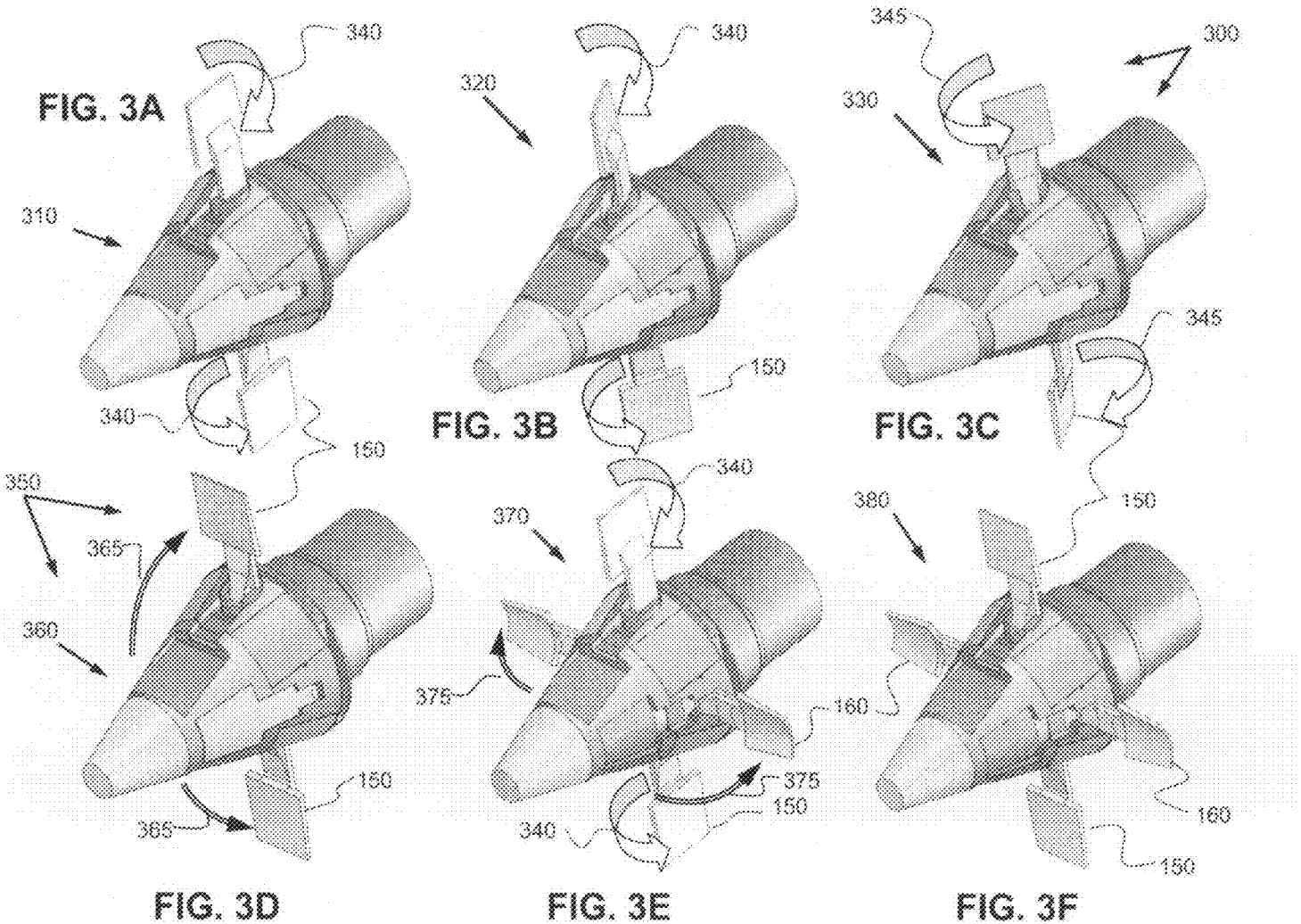
FIGS. 3A through 3F are isometric assembly views of the guided fuse in various configurations.

FIGS. 3A through 3C show isometric views 300 of the VIPER guided fuse with the control panels 150 deployed and disposed in various positions for a first drag-throttle mode, while the drag panels 160 remain stowed. FIG. 3A illustrates the VIPER in a third isometric assembly view 310 configured to maintain spin. FIG. 3B shows the VIPER in a fourth isometric assembly view 320 for anti-roll spin to de-spin the fuse. FIG. 3C shows the VIPER in a fifth isometric assembly view 330 for pro-roll spin to increase roll rotation. In the third and fourth views 310, 320, the control panels 150 pivot clockwise 340. In the fifth view 330, the control panels 150 pivot counter-clockwise 345.

FIGS. 3D through 3F show isometric views 350 of the VIPER guided fuse with the control panels 150 and the drag panels 160 deployed and disposed in various positions for a second drag-throttle mode. FIG. 3D illustrates the VIPER in a sixth isometric assembly view 360 configured at fifty-percent drag. The control panels 150 open by their knuckles 155 from stow to deploy positions by pivot angle 365, while the drag panels 160 remain stowed. FIG. 3E shows the VIPER in a seventh isometric assembly view 370 also configured at fifty-percent drag and maintained spin. The drag panels 160 open from stow to deploy positions by pivot angle 375, and the control panels 150 rotate clockwise 340. FIG. 3F shows the VIPER in an eighth isometric assembly view 380 for ninety-percent drag, with both drag panels 160 and control panels 150 deployed (with no rotation). Changes in mode state typically increase as time-to-impact diminishes.

Figure 4A:
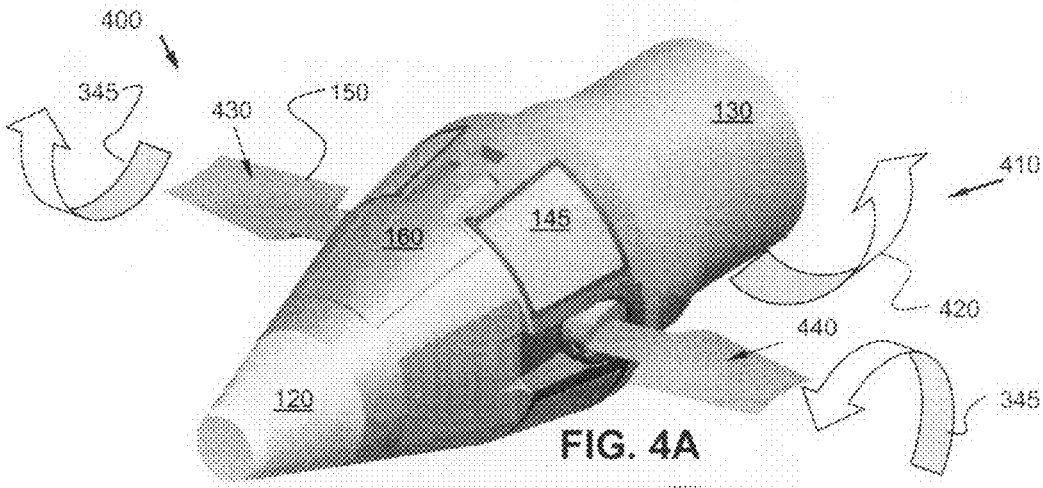
FIGS. 4A through 4C are isometric assembly views of a guided fuse in various configurations.
Figure 4B:
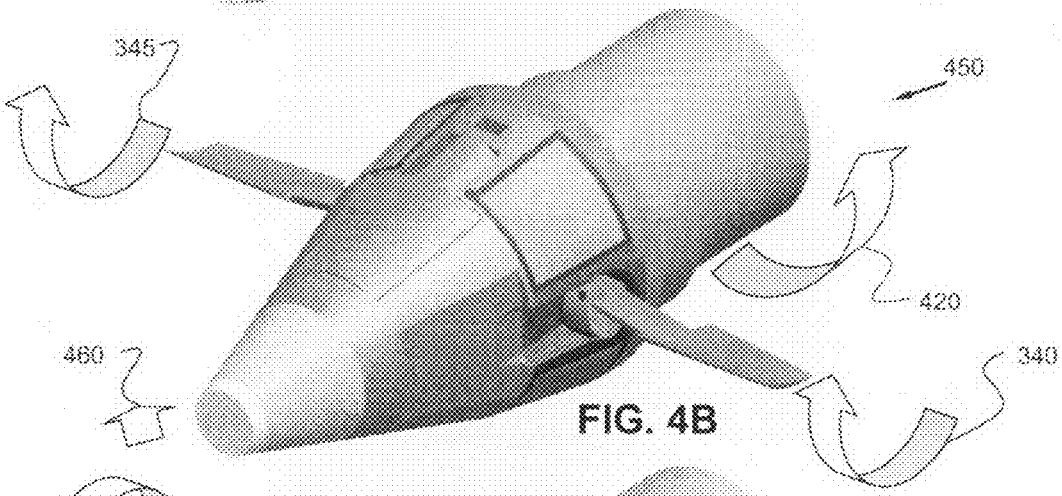
Figure 4C:
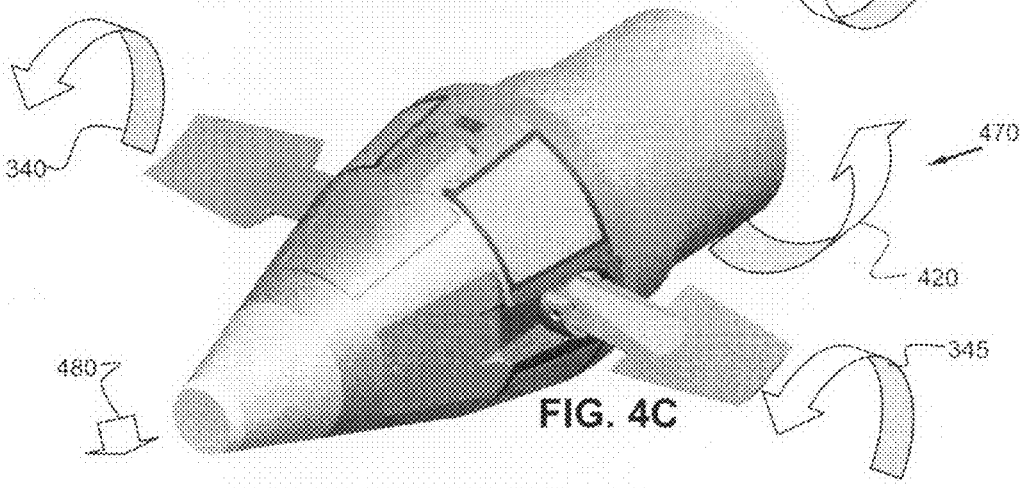

FIGS. 4A through 4C show isometric assembly views 400 of the VIPER showing decoupled positions of the control panels 150. FIG. 4A illustrates the VIPER in a ninth isometric assembly view 410 with the airframe rolling continually (counter-clockwise) along the longitudinal roll axis as indicated by turn arrow 420 with no deflection at 0° incidence. In order to conform to their corresponding recesses 180 in the assembly 120, each control panel 150 has a concave inner surface 430 and a convex outer surface 440. The control panels 150 deploy as inverted from each other, such that the concave surface 430 faces upward for the starboard panel and the convex surface 420 faces upward for the port panel by rotating both control panels 150 counter-clockwise 345.

FIG. 4B illustrates the VIPER in a tenth isometric assembly view 450 with the control panels 150 having concave surfaces 430 facing upward and with the airframe rolling continually with positive deflection at +15° incidence 460. This pitch-up maneuver can be achieved by oppositely rotating the starboard control panel 150 counter-clockwise 345 and the port control panel 150 clockwise 340. FIG. 4C illustrates the VIPER in an eleventh isometric assembly view 470 with the control panels 150 with the airframe rolling continually with negative deflection at −15° incidence 480. This pitch-down maneuver can be achieved by oppositely rotating the starboard control panel 150 clockwise 340 and the port control panel 150 counter-clockwise 345.

Figure 5:
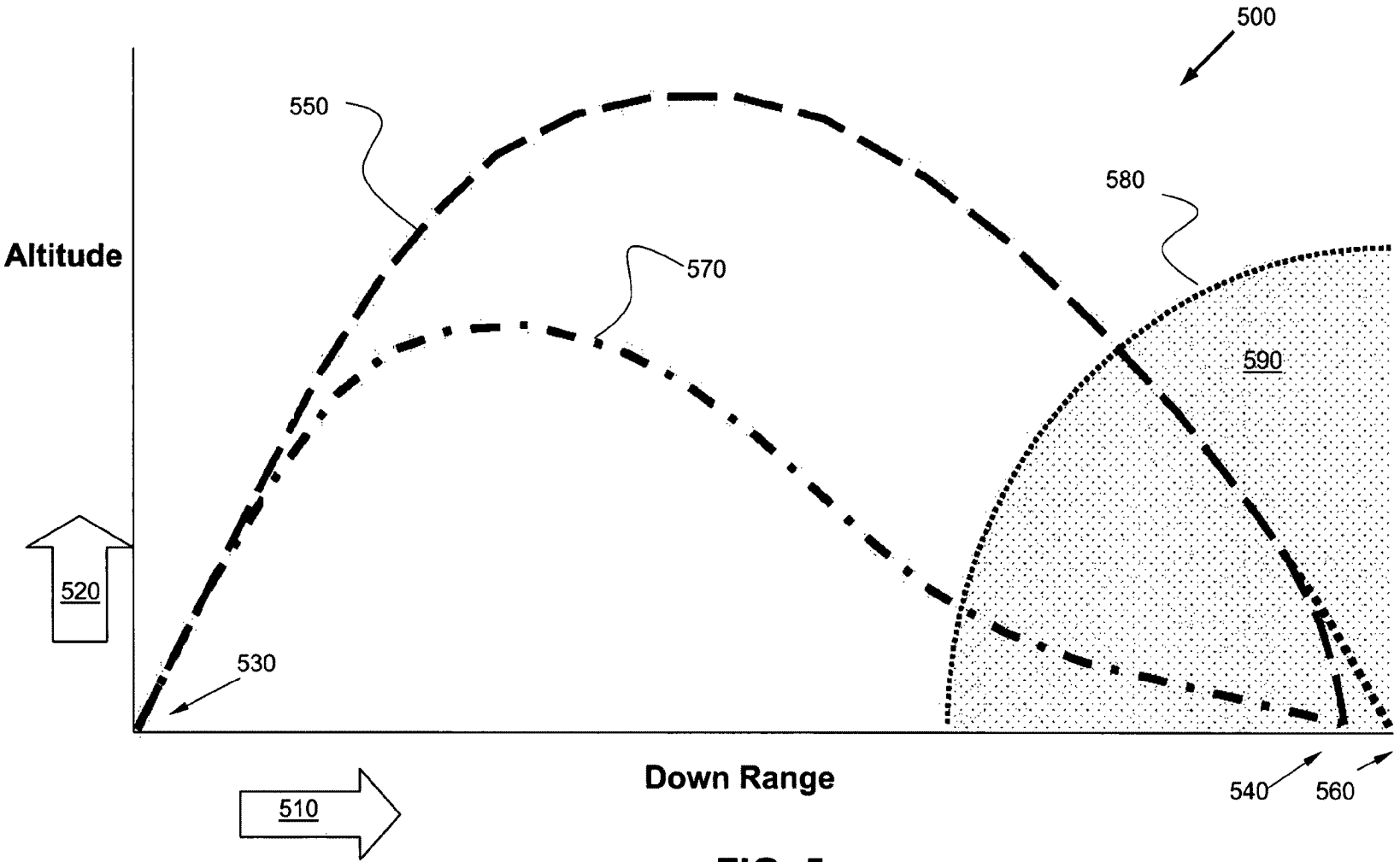
FIG. 5 is a graphical view comparing ballistic and fuse-guided trajectories.

FIG. 5 shows a graphical view 500 comparing flight trajectory of a conventional fuse to the VIPER. The abscissa 510 represents down-range distance and the ordinate 520 represents altitude. The projectile launches from a launch position 530 towards an intended target position 540. A ballistic trajectory 550 corresponds to a parabolic flight path that unless corrected can pass by the target at an overshoot position 560 farther down-range. A shallower glide path trajectory 570 gains less altitude than the ballistic mode and approaches the target position 540 in a glide path resembling a witch of Agnesi curve at a slower speed (M=0.6) than the ballistic trajectory 550. The target 540 lies within a region having a spherical boundary 580 that defines a GPS denial zone. With the VIPER, the ballistic trajectory 550 uses FITS guidance to adjust down-range distance to the target 540 without inertial maneuvering prior to reaching the boundary 580 beyond which GPS signals may be unavailable due to jamming.

Prior to gun launch, target coordinates and fuze modes are transmitted to VIPER via a setter unit (e.g., EPIAFS) located on or nearby the firing platform. After launch, the VIPER de-spins from the main projectile body through torques produced by two miniature "anti-roll" strakes located on the nose of the projectile. Upon completion of the de-roll process, the flight processor calibrates the COTS-based roll-rate sensor and magnetometer to orient the GPS antenna 145 in the "up" direction.

Following this orientation procedure, the GPS receiver interrogates the GPS navigation signal. Once achieved, the flight processor continues to refine the roll-loop calibration and begins to estimate the miss distance from impaction error resulting from the projectile's present trajectory. Steering control surfaces are deployed as control panels 150 when the flight processor determines that trajectory corrections are necessary. For additional flight adjustment, drag panels 160 can be deployed to shorten the trajectory.

The VIPER guidance law can then steer the projectile to a trajectory to produce a ballistic interception with the pre-set target coordinates. Encoded updates to the target's position (if available) enables the in-flight projectile to be re-directed as necessary to yield a terminal accuracy of less than 10 meters. However, the use of relative or wide-area differential GPS could result in improved accuracies of 3-to-5 meters.

The fuse can be initiated based on different criteria. Five fuze modes are envisioned for VIPER: variable time, height-of-burst (HOB), closest approach, delayed HOB and impact. The HOB can be based on the MOFA altimeter. The closest approach can be based on target's and projectile GPS coordinates. The delayed HOB can be set with a fuse time-offset after HOB indication.

The continuing emphasis on quick-response self-defense, high-mobility amphibious assault and quick-strike, there is a pressing need to develop a system that will enable our present resources to perform their functions in a far more cost effective and timely manner. VIPER represents a "smart fuse" designed to be a one-for-one replacement to the NATO Standard Fuses presently used by the US Army, Marines, Navy and many NATO countries.

The VIPER concept leverages the Radar Altimeter, S&A and warhead initiator subsystems of the Army's MOFA, already in production. Guidance, Navigation and Control (GN&C) functions can be implemented with COTS power sources, inertial sensors, miniature GPS receivers, digital signal processors, actuators and precision bearings. The result is a low-cost and retro-fittable product containing all the necessary functions to achieve both an accurate impact and the effective initiation of the warhead.

With a production base literally in the millions, the added cost of precision navigation can be driven down to approximately $2 k per round. This doubles the flyaway cost of present Army and Navy projectiles, but can reduce the cost of the required rounds by a factor of 20 to 40, depending on the target type, with a similar reduction in the time required to achieve a kill. This translates into a 10- to 20-fold reduction in the cost and time required to destroy an identified threat, based entirely on existing munitions stores.

The Defense Department requires that GPS-based guidance systems include a backup or "causality navigation" mode for contingency situations of compromised GPS availability. This requirement applies to VIPER because of its reliance on GPS for the projectile's primary method of navigation, in which the target's GPS position is pre-loaded into the VIPER fuse prior to launch. The fuse then autonomously acquires the available GPS satellites, auto-locates itself and then homes on the provided target position.

The alternative method of navigation employs a "command guidance" mode in which the firing platform tracks the projectile, which is commanded to steer toward the target via a communication uplink incorporated in the VIPER fuse. At short ranges and on platforms with tracking systems, this command guidance mode can be more accurate than in the GPS mode and is very resistant to countermeasures. Existing munitions, whether spin or fin stabilized, typically go through flight regimes of very low static and dynamic stability. Control surfaces, especially those at high incidence, can erase these margins. Nevertheless, control surfaces are frequently necessary to affect the required maneuvers.

No single set of fixed control surfaces exists that produces effective control over all flight conditions and munitions-types while also avoiding flight instability. To address this problem, VIPER utilizes a variable-incidence control system that can be dynamically controlled through a wide range of deflections and flight regimes. The aerodynamic characteristics and mass properties of dozens of munitions can be stored in the operational flight software of the VIPER fuse. This enables the fuse's flight management system to optimally control a host of munitions without introducing undesirable flight dynamics.

Depending on the projectile's warhead size and type, a relatively larger number of S&A and primer configurations are possible. Currently, very few adaptable fuses operate safely with different warheads. The VIPER fuse concept provides a modular base intrusion feature that enables different S&A and primer elements to be integrated into assemblies, thereby supporting many different warhead types. Previous guided fuse concepts either violate the NATO STANAG-333b requirement or have explosively discarded elements. These undesirable features complicate the manufacturing process and represent potential hazards to friendly troops, aircraft rotors and jet intakes. In addition, fuses which violate the NATO envelope are generally incompatible with existing autoloader systems throughout the Tri-Services. The VIPER fuse is compatible with all in-service autoloaders and contains no discarding elements or explosively deployed parts.

Presently, there are tens of millions of munitions (projectiles, mortars and rockets) in the inventories of the United States armed forces and NATO that comply with the "standardized" STANAG 333b (MIL-STD-333B) fuse envelope and interface. The lethality of these weapons is generally acceptable against a wide range of targets given an accurate delivery. However, accuracy represents a fundamental problem, such that deficiencies of which greatly reduce the effectiveness of both individual rounds and the cumulative effects of a large volley. In fact, most of these munitions require dozens of rounds to affect target destruction, even when forward observers can provide corrective fires.

Figure 6A:
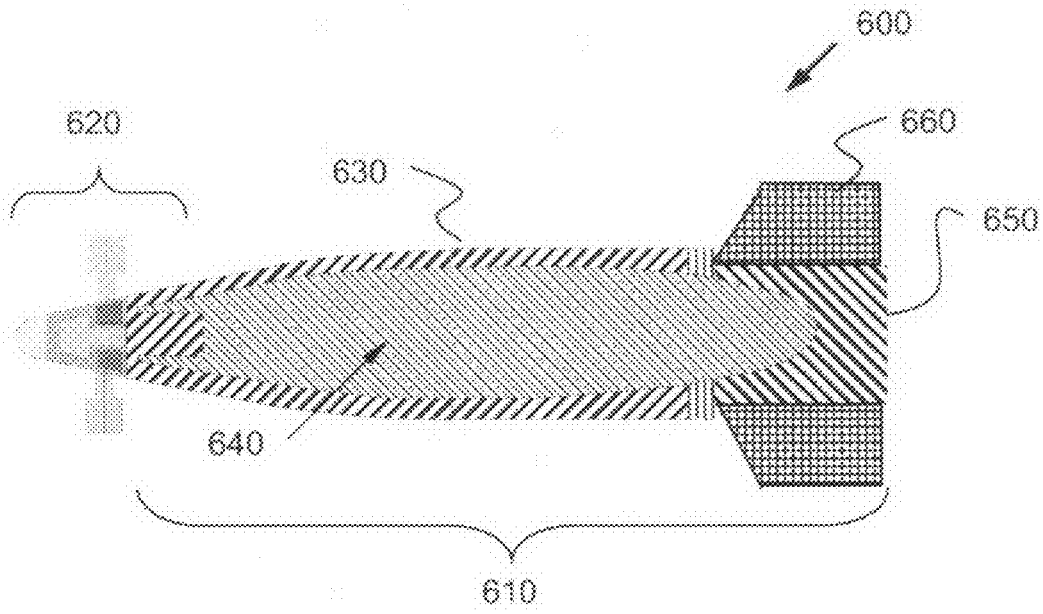
FIGS. 6A and 6B are elevation cross-sectional views of exemplary projectiles equipped with the guided fuse.
Figure 6B:
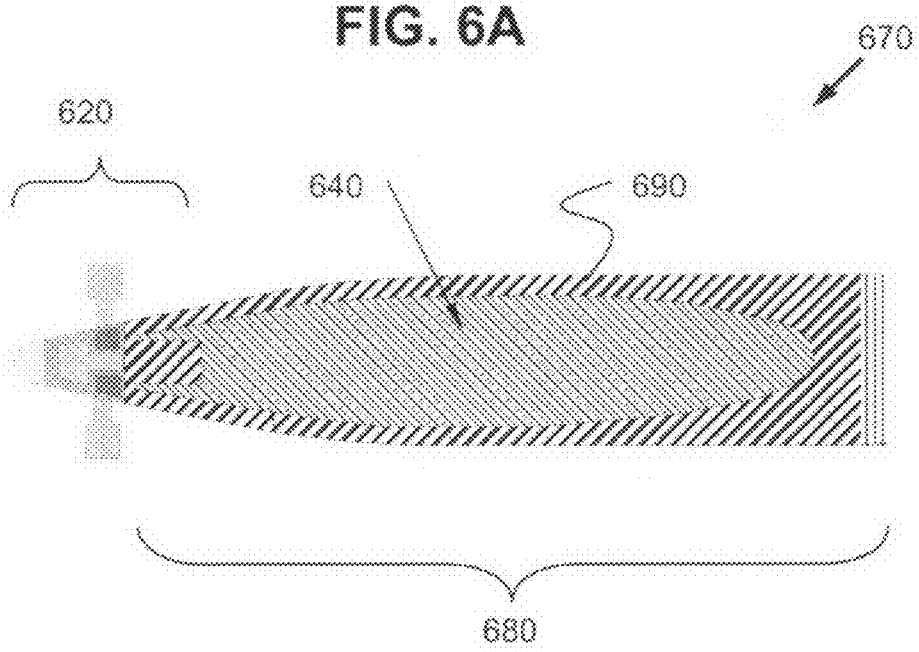

FIG. 6A presents an elevation cross-section view 600 of a first exemplary fin-stabilized projectile 610 equipped with a VIPER guided fuse 620 mounted at the projectile's nose tip. The projectile 610 includes a shell 630 filled with explosive 640 and terminating in a tail 650 equipped with fins 660. The fuse 620 guides the finned projectile 610 by the Lift Method. By contrast, FIG. 6B presents an elevation cross-section view 670 of a second exemplary spin-stabilized projectile 680 equipped with the VIPER guided fuse 620 mounted at the tip. The projectile 680 includes a shell 690 filled with explosive 640. The fuse 620 guides the spinning projectile 680 by the Momentum Method. These are simplified examples of the VIPER fuse installation at the fore on a variety of munitions.

The VIPER fuse can radically reduce the cost-per-kill and time and per-kill of major caliber ammo types throughout the Tri-Services. Clearly, a first round capability is highly desirable for the Army, Navy and the Marines. Such a capability reduces the time required for a target's defeat, minimizes the war-fighter's exposure to counter-fire, improves the weapon system's kill rate, increases mobility and sustainability and greatly reduces the logistics support of the weapon system. Guided Projectiles provide these advantages yet, to date, these have been very expensive, with production costs between $35 k and $50 k per round.

The "Common Fuse" interface of the NATO Standard fuse envelope affords the opportunity to develop a single, low-cost yet very ubiquitous "Smart" Fuse that enable conversion of tens of millions of munitions in inventory into Guided Weapons Systems with improved accuracies by at least an order-of-magnitude than their present capabilities. New and/or developmental munitions, even those that do not utilize the NATO interface, can be accommodated via the use of application specific adapters. In addition, the utilization of inexpensive, non-developmental and commercial-off-the-shelf components also has the potential to produce a low-cost effective product applicable to not only American services but also those within NATO.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A guided fuse for installation on a projectile at its nose, said fuse comprising:

a housing having a substantially conical frustum geometry with a radially expanding exterior disposed between a fore tip and an aft base along a longitudinal axis;

a pair of control panels disposed on pivotable knuckles inserted in said housing, each control panel releasing on first release command from first stowage to first deployment, said first stowage disposing each said control panel to conform against said exterior, said first deployment extending each said control panel radially outward from said exterior, responsive to maneuver command said each control panel turning on said knuckles along a control axis substantially perpendicular to said longitudinal axis, said pair of control panels turning together in one of same angular direction and opposite angular direction; and a pair of drag panels disposed on hinges, each drag panel releasing on second release command from second stowage to second deployment, said second stowage disposing said each drag panel to conform against said exterior, said second deployment extending each drag panel radially outward from said exterior.

2. The fuse according to claim 1, further comprising:

a plurality of antenna patches disposed to conform against said exterior and distributed between said pair of control panels and said pair of drag panels.

3. The fuse according to claim 1, wherein said pluralities of control panels and of said drag panels form a cruciform pattern along said exterior.

4. The fuse according to claim 2, wherein said pluralities of control panels and of said drag panels form a first cruciform pattern along said exterior, and said plurality of antenna patches forms a second cruciform pattern along said exterior, said first and second cruciform patterns being angularly offset by 45°.

5. The fuse according to claim 1, further comprising:

an adaptor containing an actuator, said adaptor disposed at said base, wherein said actuator transmits torque through a torque box in said housing to said knuckles in response to at least one of said first release command and said maneuver command, said actuator transmits torque through said torque box to said hinges in response to said second release command, said controller activating a motor in response to said release and maneuver commands, and a power supply providing motive energy to said motor.

6. The fuse according to claim 5, wherein said power supply contained in said adaptor provides motive energy to said actuator.

7. The fuse according to claim 1, wherein said base includes screw threads for installing in the nose of the projectile.

8. The fuse according to claim 1, wherein said base includes an initiator to initiate a payload of the projectile.

9. The fuse according to claim 8, wherein said tip includes an altimeter that communicates with said initiator.

10. The fuse according to claim 8, wherein said tip includes a terminal seeker that communicates indication of contact with said initiator.

* * * * *